US010323498B2

(12) United States Patent
Sun et al.

(10) Patent No.: US 10,323,498 B2
(45) Date of Patent: Jun. 18, 2019

(54) METHODS, COMPUTER-READABLE MEDIA, AND SYSTEMS FOR APPLYING 1-DIMENSIONAL (1D) PROCESSING IN A NON-1D FORMATION

(71) Applicant: Schlumberger Technology Corporation, Sugar Land, TX (US)

(72) Inventors: Keli Sun, Sugar Land, TX (US); Koji Ito, Sugar Land, TX (US); Christopher E. Morriss, Sugar Land, TX (US); Roger Griffiths, Selangor (MY); Steve F. Crary, Al-Khobar (SA); Shahzad A. Asif, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 369 days.

(21) Appl. No.: 15/026,232

(22) PCT Filed: Oct. 1, 2014

(86) PCT No.: PCT/US2014/058615
§ 371 (c)(1),
(2) Date: Mar. 30, 2016

(87) PCT Pub. No.: WO2015/050985
PCT Pub. Date: Apr. 9, 2015

(65) Prior Publication Data

US 2016/0237801 A1 Aug. 18, 2016

Related U.S. Application Data

(60) Provisional application No. 61/885,215, filed on Oct. 1, 2013.

(51) Int. Cl.
*E21B 44/00* (2006.01)
*E21B 7/06* (2006.01)
(Continued)

(52) U.S. Cl.
CPC ..... *E21B 44/00* (2013.01); *E21B 7/06* (2013.01); *E21B 44/005* (2013.01); *E21B 47/02* (2013.01); *E21B 47/12* (2013.01); *E21B 49/00* (2013.01)

(58) Field of Classification Search
CPC ..... G01V 3/083; G01V 11/00; G06T 17/05; E21B 44/00
See application file for complete search history.

(56) References Cited

U.S. PATENT DOCUMENTS 5,675,147 A 10/1997 Ekstrom et al.
7,317,991 B2 1/2008 Wang et al.
(Continued)

FOREIGN PATENT DOCUMENTS

WO 2013036509 A1 3/2013
WO 2015050985 A1 4/2015

OTHER PUBLICATIONS

Wabg et al., "Triaxial induction logging: Therory, modeling, inversion and Interpretation", SPE 103897, 2006.*
(Continued)

*Primary Examiner* — Kandasamy Thangavelu

(57) ABSTRACT

Methods, computer-readable media, and systems are disclosed for applying 1D processing in a non-1D formation. In some embodiments, a 3D model or curtain section of a subsurface earth formation may be obtained. A processing window within the 3D model or curtain that is suitable for 1D inversion processing is determined, and a local 1D model for the processing window is built. A 1D inversion is performed on the local 1D model, and inverted formation parameters are used to update the 3D model or curtain section.

20 Claims, 11 Drawing Sheets

(51) Int. Cl.

| | |
|---|---|
| ***E21B 47/02*** | (2006.01) |
| ***E21B 47/12*** | (2012.01) |
| ***E21B 49/00*** | (2006.01) |

(56) References Cited

U.S. PATENT DOCUMENTS

| | | | | |
|---|---|---|---|---|
| 7,382,135 | B2 | 6/2008 | Li et al. | |
| 7,542,037 | B2 | 6/2009 | Fremming | |
| 8,433,518 | B2 | 4/2013 | Omeragic et al. | |
| 2007/0083330 | A1 | 4/2007 | Frenkel | |
| 2008/0071709 | A1* | 3/2008 | Strack | G01V 3/083 706/20 |
| 2008/0289877 | A1 | 11/2008 | Nikolakis-Mouchas et al. | |
| 2009/0119076 | A1 | 5/2009 | Madatov et al. | |
| 2010/0327885 | A1* | 12/2010 | Ziolkowski | G01V 3/083 324/691 |
| 2011/0074427 | A1 | 3/2011 | Wang et al. | |
| 2011/0238312 | A1 | 9/2011 | Seydoux et al. | |
| 2011/0251830 | A1 | 10/2011 | Hilliard et al. | |
| 2011/0282634 | A1* | 11/2011 | Marza | G06T 17/05 703/2 |
| 2013/0080058 | A1 | 3/2013 | Wu et al. | |
| 2013/0173163 | A1* | 7/2013 | Zhandov | G01V 11/00 702/2 |

OTHER PUBLICATIONS

Li et al., "New Directional Electromagnetic Tool for Proactive Geosteering and Accurate Formation Evaluation While Drilling." SPWLA 46th Annual Logging Symposium held in New Orleans, Louisiana, United States, Jun. 26-29, 2005. 16 pages.

Kriegshauser et al., A New Multicomponent Induction Logging Tool to Resolve Anisotropic Formations. SPWLA 41st Annual Logging Symposium Jun. 4-7, 2000. 14 pages.

Pitcher et al., Interpreting Azimuthal Propagation Resistivity: A Paradigm Shift. SPE 143303. SPE Europe C/EAGE Annual Confrerence and Exhibition held in Vienna, Austria, May 23-26, 2011. 16 pages.

Griffiths et al., "Formation Evaluation in High Angle and Horizontal Wells—A New and Practical Workflow." SPWLA 53rd Annual Logging Symposium held in Cartagena, Colombia, Jun. 16-20, 2012. 16 pages.

International Preliminary Report on Patentability issued in corresponding International application PCT/US2014/058615 dated Apr. 14, 2016. 7 pages.

International Search Report and the Written Opinion for International Application No. PCT/US2014/058615 dated Jan. 7, 2015.

* cited by examiner

METHODS, COMPUTER-READABLE MEDIA, AND SYSTEMS FOR APPLYING 1-DIMENSIONAL (1D) PROCESSING IN A NON-1D FORMATION

CROSS-REFERENCE TO RELATED APPLICATION

This application claims priority from U.S. Provisional Application 61/885,215, filed Oct. 1, 2013, which is incorporated herein by reference in its entirety.

BACKGROUND

This disclosure relates to evaluating geological formations and, more particularly, to the determination of formation parameters using electromagnetic measurements.

Multi-component directional electromagnetic tools and algorithms have been developed to obtain formation resistivity (e.g., horizontal resistivity—Rh; and vertical resistivity—Rv), anisotropy, and formation dips. In many processing methods, the earth is assumed to be a 1D (1-dimensional) layered mud cake model. 1D processing algorithms can be used for computing electromagnetic induction and propagation responses in 1D layered formation models. Generally, 1D processing provides a fast analytical solution within a reasonable amount of time, and thus inversions based on 1D processing are practical for solving for resistivity, anisotropy, formation dip, and/or layer thicknesses using a 1D layered mud cake model. However, in most real world instances, subsurface formations in the Earth are not a 1D structure, but rather 2D or 3D (non-1D).

SUMMARY

A summary of certain embodiments disclosed herein is set forth below. It should be understood that these embodiments are presented merely to provide the reader with a brief summary and that these are not intended to limit the scope of this disclosure. Indeed, this disclosure may encompass a variety of embodiments and associated aspects that may not be set forth below.

Embodiments of this disclosure relate to various methods, computer-readable media, and systems for applying 1-dimensional (1D) processing in a non-1D formation. In some embodiments, a method is provided that includes obtaining, by one or more processors, a 3D model or curtain section of a subsurface earth formation and determining, by one or more processors, a processing window within the 3D model or curtain section for 1D inversion processing. The method also includes building, by one or more processors, a local 1D model for the processing window and performing, by one or more processors, a 1D inversion on the local 1D model to generate an inverted 1D model having at least one formation parameter. The method further includes updating, by one or more processors, the 3D model or curtain section using the at least one formation parameter.

In some embodiments, a non-transitory computer-readable medium is provided. The computer-readable medium includes computer-executable instructions when executed by one or more processors, causes the one or more processors to perform operations that include obtaining a 3D model or curtain section of a subsurface earth formation and determining a processing window within the 3D model or curtain section for 1D inversion processing. The computer-readable medium includes computer-executable instructions when executed by one or more processors, causes the one or more processors to perform operations that also include building a local 1D model for the processing window and performing a 1D inversion on the local 1D model to generate an inverted 1D model having at least one formation parameter. The computer-readable medium includes computer-executable instructions when executed by one or more processors, causes the one or more processors to perform operations that further include updating the 3D model or curtain section using the at least one formation parameter.

In some embodiments, a system is provided that includes one or more processors and a non-transitory tangible computer-readable memory accessible by the one or more processors. The computer-readable memory includes computer-executable instructions that when executed by one or more processors, causes the one or more processors to perform operations that include obtaining a 3D model or curtain section of a subsurface earth formation and determining a processing window within the 3D model or curtain section for 1D inversion processing. The computer-readable memory includes computer-executable instructions that when executed by one or more processors, causes the one or more processors to perform operations that also include building a local 1D model for the processing window and performing a 1D inversion on the local 1D model to generate an inverted 1D model having at least one formation parameter. The computer-readable memory includes computer-executable instructions that when executed by one or more processors, causes the one or more processors to perform operations that further include updating the 3D model or curtain section using the at least one formation parameter.

Various refinements of the embodiments, aspects, and features noted above may be undertaken in relation to various embodiments, aspects, and features of the present disclosure. Further embodiments, aspects, and/or features may also be incorporated in these various embodiments, aspects, and/or features as well. These refinements and additional embodiments, aspects, and/or features may be determined individually or in any combination. For instance, various embodiments, aspects, and/or features discussed below in relation to the illustrated embodiments may be incorporated into any of the above-described embodiments, aspects, and/or features of the present disclosure alone or in any combination. The brief summary presented above is intended to familiarize the reader with certain embodiments, aspects, features, and contexts of embodiments of the present disclosure without limitation to the claimed subject matter.

BRIEF DESCRIPTION OF THE DRAWINGS

Various embodiments, aspects, and features of this disclosure may be better understood upon reading the following detailed description and upon reference to the drawings in which.

DETAILED DESCRIPTION

Described herein are various embodiments related to applying 1-dimensional (1D) processing in a non-1D formation. A 3D earth model or curtain section of a non-1D formation may be obtained. Processing windows within the 3D earth model or curtain section that are suitable for 1D processing may be defined manually, via user input, or automatically. For example, in some embodiments, a processing window may be defined by selecting a base point and expanding a processing window until at least one stopping criterion is met. A sub-dataset for each processing window is created, and an initial local 1D model is generated for each processing window. An inversion is run on the local 1D model to generate an inverted 1D model having formation parameters such as a global dip, horizontal resistivity (Rh), vertical resistivity (Rv) and bed boundary locations. The inversion results may be used to update the 3D earth model or curtain section.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Figure 1:
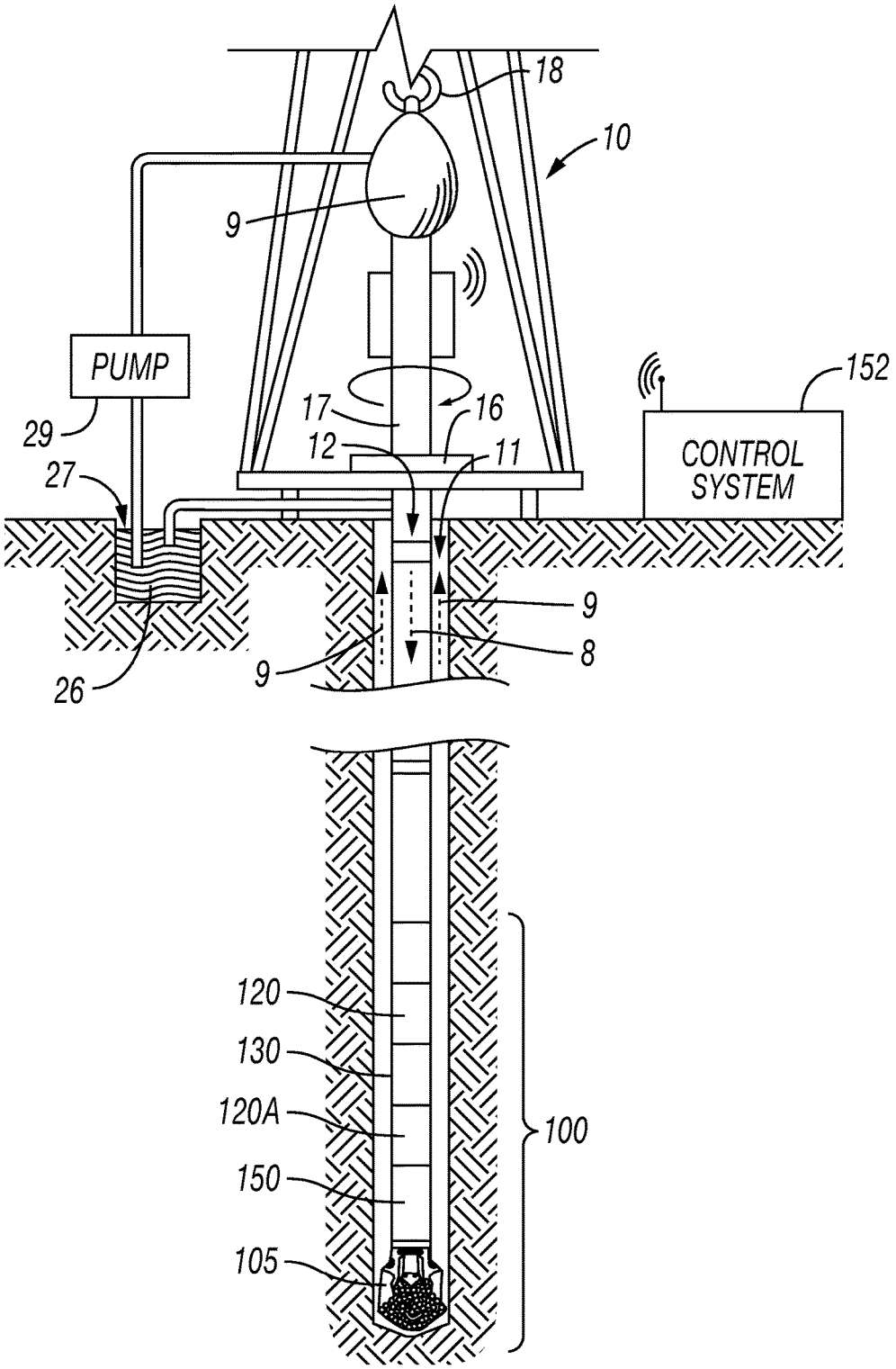
FIG. 1 is a schematic diagram of an example well site system in accordance with an embodiment of the disclosure.

FIG. 1 depicts a simplified view of an example well site system in which various embodiments can be employed. The well site system depicted in FIG. 1 can be deployed in either onshore or offshore applications. In this type of system, a borehole 11 is formed in subsurface formations by rotary drilling in a manner that is well known to those skilled in the art. Some embodiments can also use directional drilling.

A drill string 12 is suspended within the borehole 11 and has a bottom hole assembly (BHA) 100 which includes a drill bit 105 at its lower end. The surface system includes a platform and derrick assembly 10 positioned over the borehole 11, with the assembly 10 including a rotary table 16, kelly 17, hook 18 and rotary swivel 19. In a drilling operation, the drill string 12 is rotated by the rotary table 16 (energized by means not shown), which engages the kelly 17 at the upper end of the drill string. The drill string 12 is suspended from a hook 18, attached to a traveling block (also not shown), through the kelly 17 and a rotary swivel 19 which permits rotation of the drill string 12 relative to the hook 18. As is well known, a top drive system could be used in other embodiments.

Drilling fluid or mud 26 may be stored in a pit 27 formed at the well site. A pump 29 delivers the drilling fluid 26 to the interior of the drill string 12 via a port in the swivel 19, which causes the drilling fluid 26 to flow downwardly through the drill string 12, as indicated by the directional arrow 8 in FIG. 1. The drilling fluid exits the drill string 12 via ports in the drill bit 105, and then circulates upwardly through the annulus region between the outside of the drill string 12 and the wall of the borehole, as indicated by the directional arrows 9. In this known manner, the drilling fluid lubricates the drill bit 105 and carries formation cuttings up to the surface as it is returned to the pit 27 for recirculation.

The drill string 12 includes a BHA 100. In the illustrated embodiment, the BHA 100 is shown as having one MWD module 130 and multiple LWD modules 120 (with reference number 120A depicting a second LWD module 120). As used herein, the term "module" as applied to MWD and LWD devices is understood to mean either a single tool or a suite of multiple tools contained in a single modular device. Additionally, the BHA 100 includes a rotary steerable system (RSS) and motor 150 and a drill bit 105.

The LWD modules 120 may be housed in a drill collar and can include one or more types of logging tools. The LWD modules 120 may include capabilities for measuring, processing, and storing information, as well as for communicating with the surface equipment. By way of example, the LWD module 120 may include an electromagnetic logging tool.

The MWD module 130 is also housed in a drill collar, and can contain one or more devices for measuring characteristics of the drill string and drill bit. In the present embodiment, the MWD module 130 can include one or more of the following types of measuring devices: a weight-on-bit measuring device, a torque measuring device, a vibration measuring device, a shock measuring device, a stick/slip measuring device, a direction measuring device, and an inclination measuring device (the latter two sometimes being referred to collectively as a D&I package). The MWD tool 130 further includes an apparatus (not shown) for generating electrical power for the downhole system. For instance, power generated by the MWD tool 130 may be used to power the MWD tool 130 and the LWD tool(s) 120. In some embodiments, this apparatus may include a mud turbine generator powered by the flow of the drilling fluid 26. It is understood, however, that other power and/or battery systems may be employed.

The operation of the assembly 10 of FIG. 1 may be controlled using control system 152 located at the surface. The control system 152 may include one or more processor-based computing systems. In the present context, a processor may include a microprocessor, programmable logic devices (PLDs), field-gate programmable arrays (FPGAs), application-specific integrated circuits (ASICs), system-on-a-chip processors (SoCs), or any other suitable integrated circuit capable of executing encoded instructions stored, for example, on tangible computer-readable media (e.g., read-only memory, random access memory, a hard drive, optical disk, flash memory, etc.). Such instructions may correspond to, for instance, workflows and the like for carrying out a drilling operation, algorithms and routines for processing data received at the surface from the BHA 100 (e.g., as part of an inversion to obtain one or more desired formation parameters), and so forth.

Figure 2:
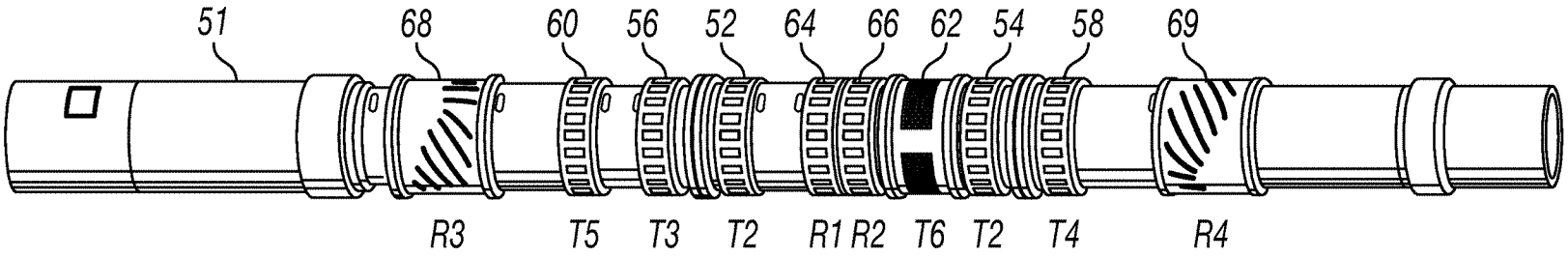
FIG. 2 is a schematic diagram of an example electromagnetic measurement tool in accordance with an embodiment of the disclosure.

FIG. 2 depicts one example of an electromagnetic measurement tool 50, which may be part of the LWD module 120 of FIG. 1. The tool 50 may be a multi-spacing directional electromagnetic propagation tool. In one embodiment, the tool 50 may be capable of making measurements at multiple frequencies, such as at 100 kHz, 400 kHz, and 2 MHz. In the depicted embodiment, the measurement tool 50 includes multiple transmitters T1, T2, T3, T4, T5, and T6 depicted at 52, 54, 56, 58, 60, and 62 and multiple receivers R1, R2, R3, and R4 depicted at 64, 66, 68, and 69 spaced axially along tool body 51. In the depicted example, measurement tool 50 includes axial, transverse, and tilted antennas. As used herein, an axial antenna is one whose dipole moment is substantially parallel with the longitudinal axis of the tool, for example, as shown at 54. Axial antennas are commonly wound about the circumference of the logging tool such that the plane of the antenna is orthogonal to the tool axis. Axial antennas produce a radiation pattern that is equivalent to a dipole along the axis of the tool (by convention the z-direction). Electromagnetic measurements made by axially oriented antennas may be referred to as conventional or non-directional measurements.

A transverse antenna is one whose dipole moment is substantially perpendicular to the longitudinal axis of the tool, for example, as shown at 62. A transverse antenna may include a saddle coil (e.g., as disclosed in commonly owned U.S. Patent Publications 2011/0074427 and 2011/0238312) and generate a radiation pattern that is equivalent to a dipole that is perpendicular to the axis of the tool (by convention the x or y direction). A tilted antenna is one whose dipole moment is neither parallel nor perpendicular to the longitudinal axis of the tool, for example, as shown at 68 and 69. Tilted antennas generate a mixed mode radiation pattern (i.e., a radiation pattern in which the dipole moment is neither parallel nor perpendicular with the tool axis). Electromagnetic measurements made by transverse or tilted antennas may be referred to as directional measurements.

In the particular embodiment depicted in FIG. 2, five of the transmitter antennas (T1, T2, T3, T4, and T5) are axial antennas spaced along the axis of the tool. A sixth transmitter antenna (T6) is a transverse antenna. First and second receivers (R1 and R2) located axially between the transmitters are axial antennas and may be used to obtain conventional non-directional type propagation resistivity measurements. Third and fourth receivers (R3 and R4) are tilted antennas located axially about the transmitters. Such a directional arrangement (including tilted and/or transverse antennas) produces a preferential sensitivity on one azimuthal side of the tool 50 that better enables bed boundaries and other features of the subterranean formations to be identified and located.

Accordingly, as the tool 50 provides both axial transmitters and axial receiver pairs as well as axial transmitter and tilted receiver pairs, the tool 50 is capable of making both directional and non-directional electromagnetic measurements. The example logging tool 50 depicted in FIG. 2 may be a model of a tool available under the name PERISCOPE from Schlumberger Technology Corporation of Sugar Land, Tex. It will be understood, however, that the embodiments disclosed herein are not limited to any particular electromagnetic logging tool configuration, and that the tool depicted in FIG. 2 is merely one example of a suitable electromagnetic logging tool.

As discussed above, the present disclosure relates to techniques and/or methods for processing non-1D formation measurements with a 1D inversion model. As described in more detail below, an embodiment of the method may include manually or automatically defining regions ("1D processing windows") where 1D approximation can be applied and running 1D inversion processing in these regions. The results from the 1D inversion processing are then used to update the 2D/3D earth model.

Figure 3:
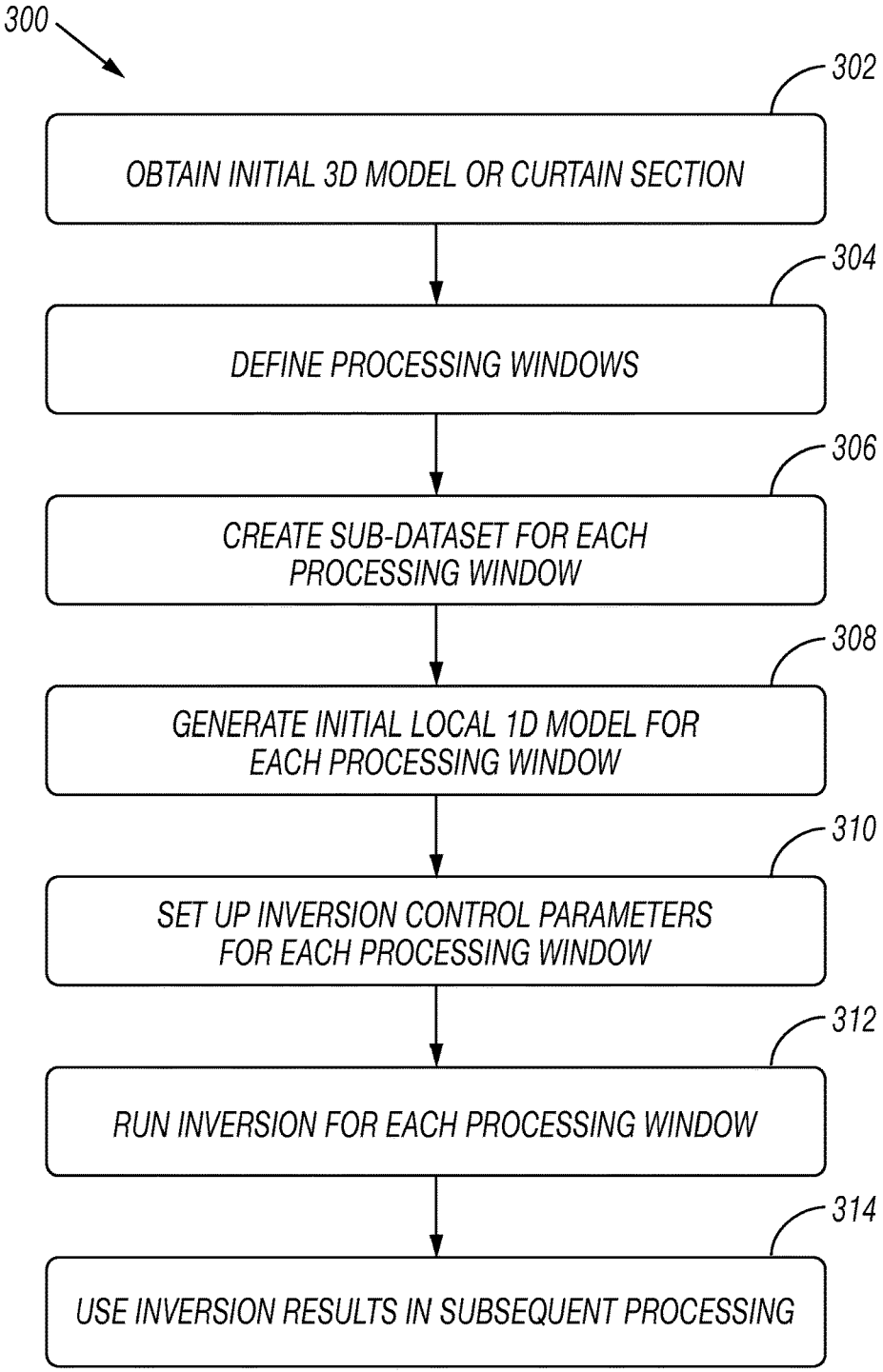
FIG. 3 is a block diagram of an example process for processing non-1D formation measurements using a 1D inversion model in accordance with an embodiment of the disclosure.

FIG. 3 depicts a process for processing non-1D formation measurements using a 1D inversion model in accordance with an embodiment of the disclosure. As described in detail below, an initial 3D earth model or curtain section may be built based on a priori knowledge about the formation. Regions (also referred to as "processing windows") where 1D processing is applicable may be defined manually, via user input, or automatically. For each identified window, measurement data and well trajectory information may be reformulated for 1D processing, and an initial local 1D model may be built based on the initial 3D earth model or curtain section. 1D inversion processing may be then be applied on each identified window to determine an inverted local 1D model that best fits the measurement data. The resulting inverted 1D model for that region of the formation is then used to update the 3D earth model or curtain section.

In some embodiments, the formation properties may include electromagnetic formation properties such as Rh, Rv, dip, azimuth, and bed boundary locations for each layer. In other embodiments, the formation properties may additionally include other suitable properties such as density, velocity, porosity, etc.

The process 300 illustrated in FIG. 3 will now be described in further detail. As shown in FIG. 3, an initial 3D earth model or curtain section may be obtained (block 302), e.g., a 3D earth model or curtain section may be built using suitable techniques. As will be appreciated, a real earth model can be described with a 3D geometry model. Based on a priori knowledge, an initial 3D earth model or curtain section can be built as a starting point for the 1D processing described below. If the formation is a layered structure, the layer boundaries can be 3D surfaces in general, such that they are not flat planes and are not necessarily parallel to each other.

Figure 4:
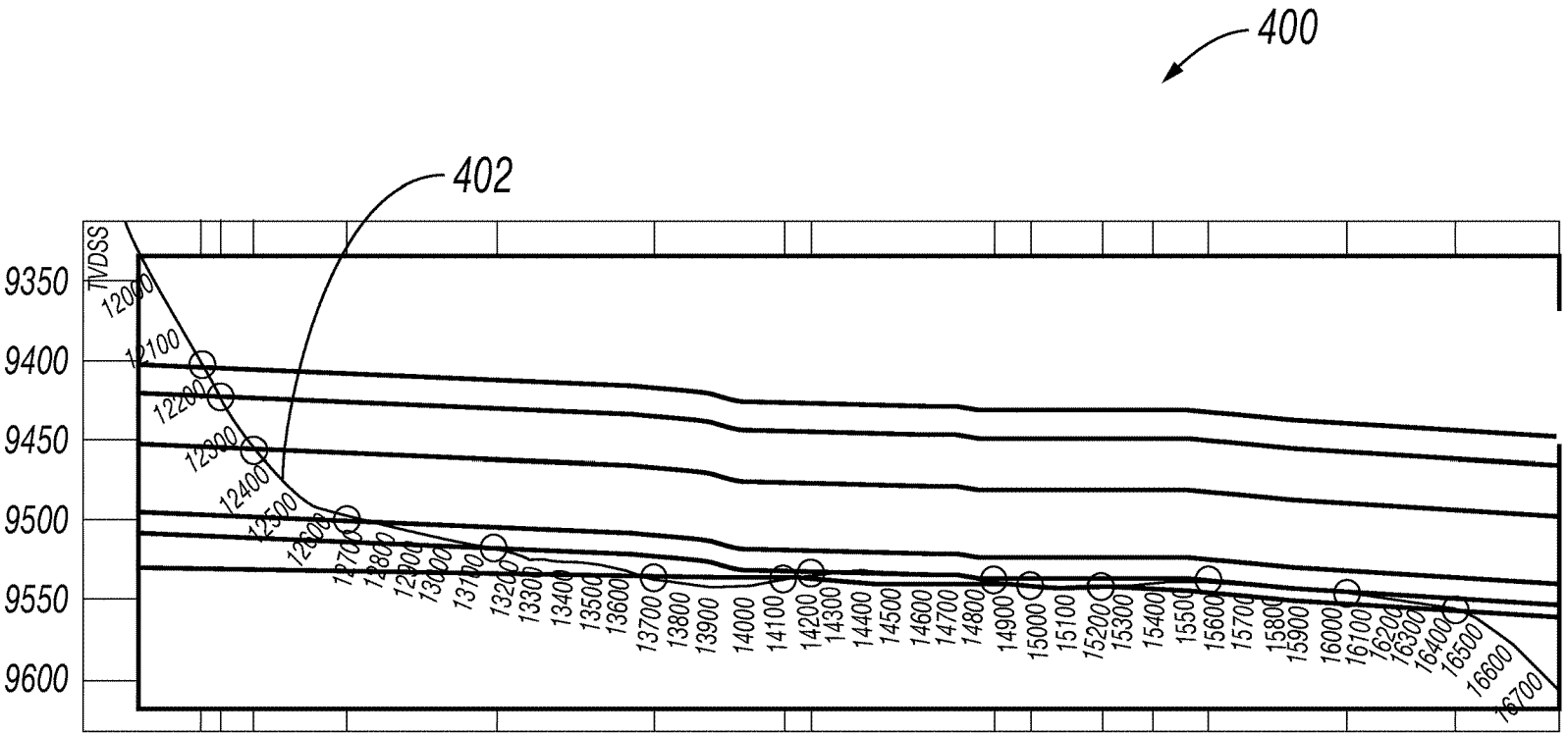
FIG. 4 is a diagram of an example curtain section obtained from modeling/interpretation software in accordance with embodiment of the disclosure.

In other embodiments, such as where the layer boundaries are approximately plane shape, the formation can be expressed with curtain sections, such as used in Techlog/3DPetrophysics (3DP) modeling/interpretation software available from Schlumberger. A typical curtain section 400 is shown below in FIG. 4 below with true horizontal length (THL) as the horizontal axis and true vertical depth (TVD) as the vertical axis. As shown in FIG. 4, a well trajectory 402 is shown crossing several layers. The layer boundaries are shown as lines in the curtain section. The boundary lines may be straight lines or any arbitrary 2D curves and not necessarily parallel to each other. The boundary lines may define the boundary position and dip angles within the curtain section plane (on the plane dip). The boundary plane can rotate around the boundary lines so that they become non-perpendicular to the curtain section. The rotation angle of the rotation may be defined as out of plane dip. The rotation angle when considered together with on the plane dip, defines the actual dip and azimuth of the bedding planes. For resistivity properties, horizontal resistivity (Rh) and vertical resistivity (Rv) can be assigned for each layer.

Next, processing windows where 1D processing is applicable may be defined (block 304). As will be appreciated, 1D processing may approximate the earth with a 1D layered structure with beddings parallel to each other. However, formations with non-1D structure generally may not be processed with 1D inversion algorithms to obtain accurate results. In some embodiments, defining the processing windows may include searching through the whole well and identifying regions where 1D processing is applicable. As described below, 1D inversion processing may be applied in the identified windows. The definition of processing windows for curtain sections is illustrated in FIG. 5 and described in more detail below. Next, sub-datasets may be created for each defined window (block 306). For example, the sub-datasets may include measurement and well trajectory information.

As shown in FIG. 3, an initial local 1D model may be generated for each window (block 308). Next, 1D inversion control parameters for each window may be determined (block 310), and a 1D inversion is run for each window (block 312). The results of the 1D inversions (e.g., an inverted 1D model and formation parameters) may be used in subsequent processing (block 314), such as to update a 2D or 3D earth model.

As noted above, in order to run 1D processing within a local region, the formation within the region should be approximately a 1D layered structure. In embodiments having a 3D model, the 1D layered structure may be determined by checking the angle of each layer within the region and depth of investigation (DOI) of the measurement tool (e.g., tool 50 of FIG. 2). The normal direction of the bed boundary surfaces are compared with each other, and the local 1D region (e.g., window) is defined so that the angle between the normal directions are below a cutoff value.

Figure 5A:
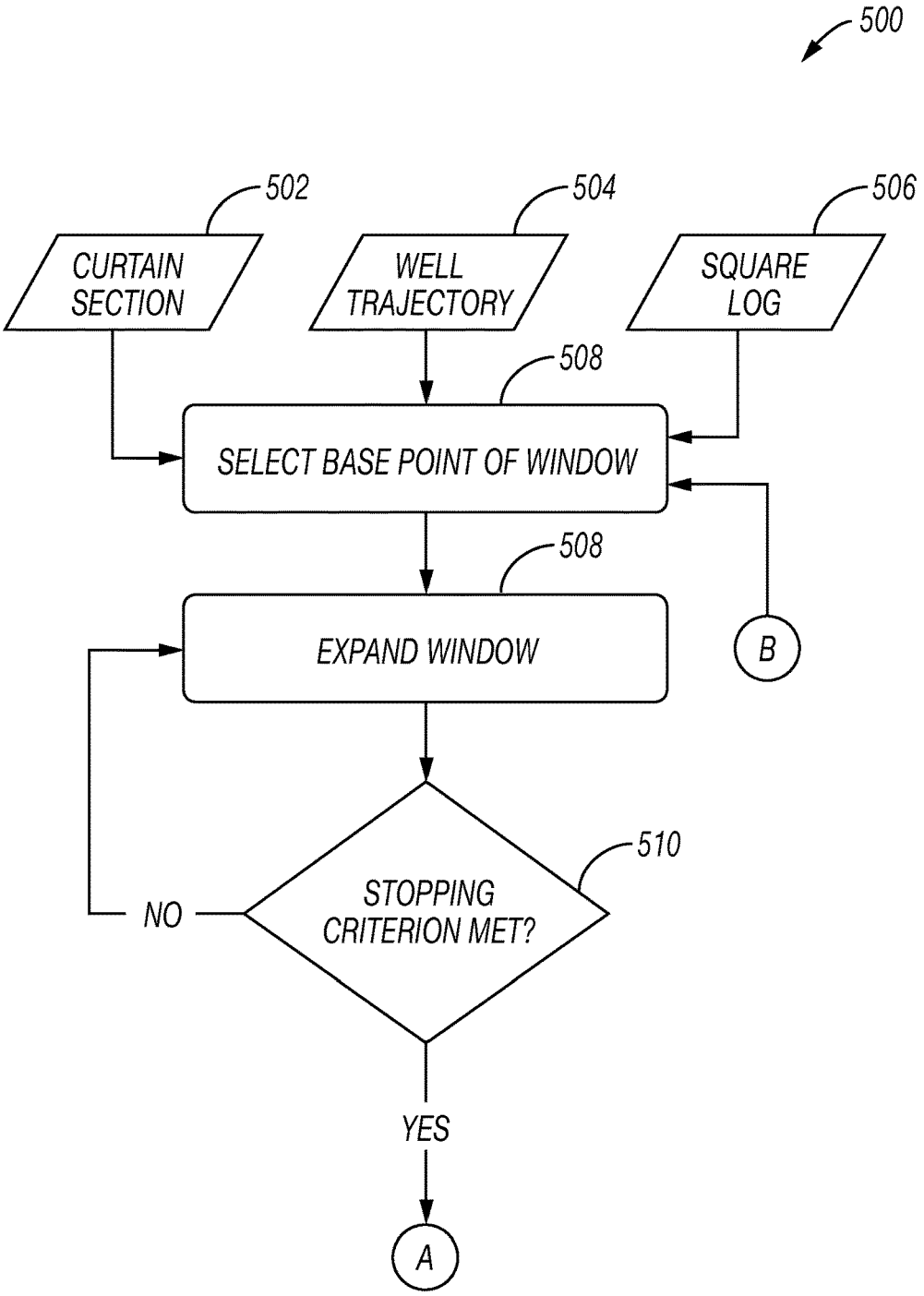
FIGS. 5A and 5B are block diagrams for defining example 1D processing windows in accordance with an embodiment of the disclosure.

If the formation is described with a curtain section, then a 1D processing window may, in some embodiments, be defined (block 304 of process 300) in accordance with the process 500 shown below in FIGS. 5A and 5B. As shown in FIG. 5A, the process 500 may receive, as input, a curtain section 502, a well trajectory 504 and a square log 506. In some embodiments, the square log 506 may include measurement depth for each boundary crossing points, boundary surface dip and azimuth angle at each crossing, as well as Rh and Rv between the crossing points.

Next, as shown in FIG. 5, a base point of a 1D window may be selected (block 508). In some embodiments, the base point of a window may be selected manually, via input from a user, or automatically according to different rules, criteria, or both, depending on the application. In some embodiments, the full 1D model may be determined (e.g., formation properties Rh, Rv, dip and bed boundaries). In such embodiments, dip and bed boundaries inversion generally rely on resistivity contrast in different layers. Thus, in such embodiments, it may be desirable to include sufficient contrast within the window. Consequently, in such embodiments a base point may be selected by searching through all the bed crossing positions and selecting the crossing with the highest contrast as the base point of the window.

The window may be expanded to the left and right along the well trajectory (block 510) until a stopping criterion is met (decision block 510). In accordance with various embodiments, the stopping criterion my include but are not limited to the following:

1. Bedding angles at each crossing point. The difference between the bedding angles and that of the base point may be compared to a cutoff value. The window may be expanded while the difference is below the cutoff value. In some embodiments, the difference between all the bedding angles may be compared to a second cutoff value, and the window may be expanded while the difference is below the second cutoff value;
2. The plane dip of all the bed boundaries within the window. The difference between these dips and that of the base point may be compared to a cutoff value, and the window may be expanded while the difference is below the cutoff value. The difference between all the plane dips may be compared to a second cutoff value, and the window may be expanded while the difference is below the second cutoff value;
3. The trajectory azimuth variation. The trajectory azimuth variation may be compared to a cutoff value, and the window may be expanded while the difference is below the cutoff value;
4. Total window length of the window. The total window length within the window may be compared to a cutoff value, and the window may be expanded while the difference is below the cutoff value. Satisfying this criterion will help to ensure accuracy of the inversion performance;
5. No (zero) property variation boundaries within the window;
6. No (zero) faults within the window;
7. The well trajectory does not cross the same layer bed boundary more than once;
8. Bed thickness variations. The bed thickness variations may be compared to a cutoff value, and the window may be expanded while the difference is below the cutoff value;
9. The number of layers within a window. The number of layers may be compared to a cutoff value, and the window may be expanded while the difference is below the cutoff value.

Once the resulting starting and ending measurement depth (MD) is determined, the actual formation region can be defined according to measurement sensor DOI. The part of the formation that the sensor has sensitivity when traveling from a starting MD and an ending MD may be defined as the 1D processing window.

Figure 5B:
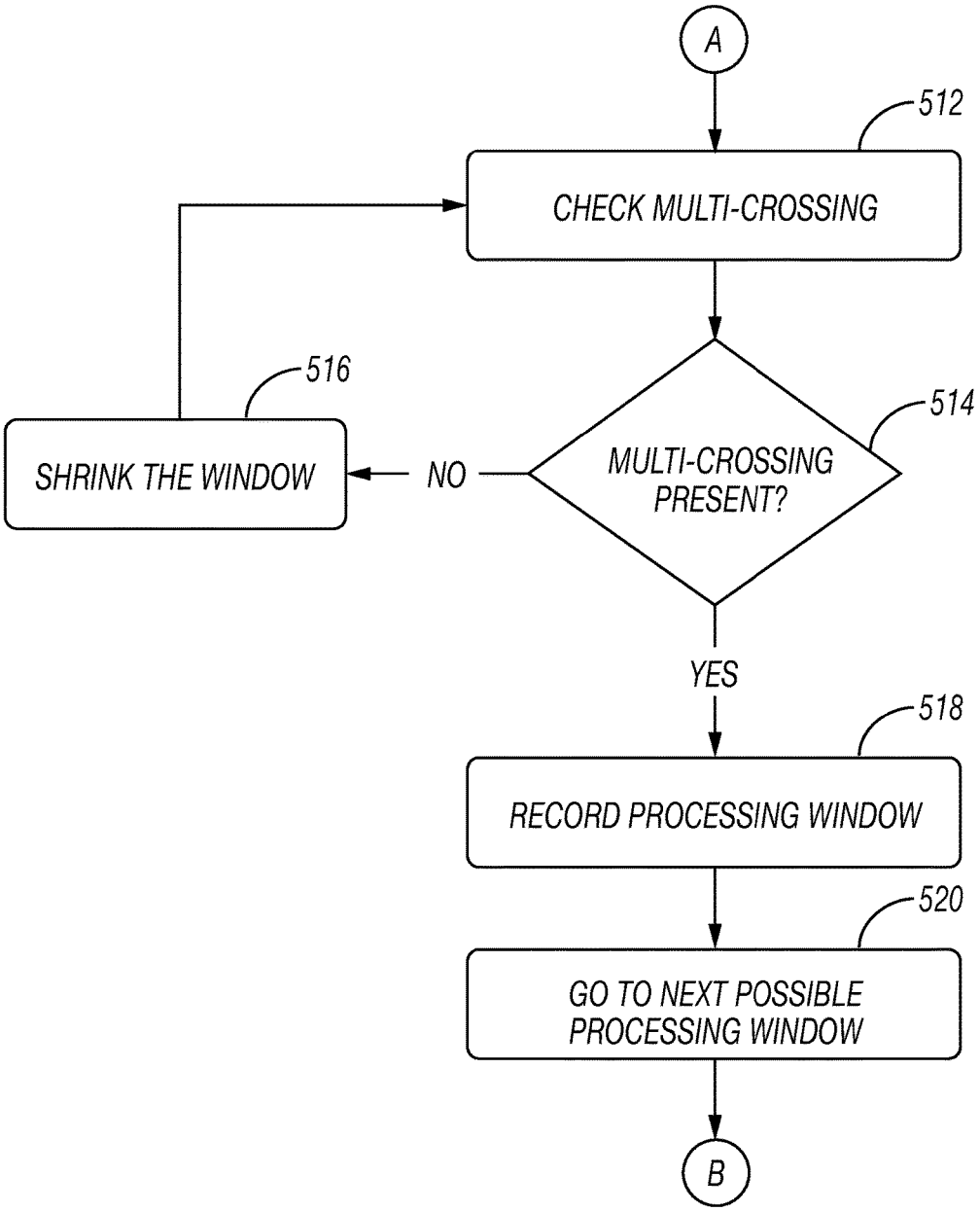

As shown by connection block A, the process 500 is further illustrated in FIG. 5B. As shown in FIG. 5B, the window may be checked for multi-crossings (block 512) to determine if multi-crossings are present in the window (decision block 514). If multi-crossings are present, the window may be shrunk (block 516) and the multi-crossing rechecked (block 512). If no multi-crossings are present, the process 500 may record the current window as a 1D processing window (block 518). As shown in FIGS. 5A and 5B and by connection block B, the next possible window may be determined (block 520) by selecting the base point of a second window (block 508). In some embodiments, after a first window is defined, the base point for the next window may be determined by searching through all the crossing points outside of the first window and locating a crossing point with the highest contrast for use as the base point for searching for a second window. In some embodiments, this window defining process can continue until all the valid windows are defined. In cases of a highly non-1D formation, the expansion of a window to the left and right may be limited, such that the resulting window is relatively small. Because inversion results can be unreliable for very small windows, in some embodiments windows smaller than a selected cutoff size may be rejected.

Figure 6:
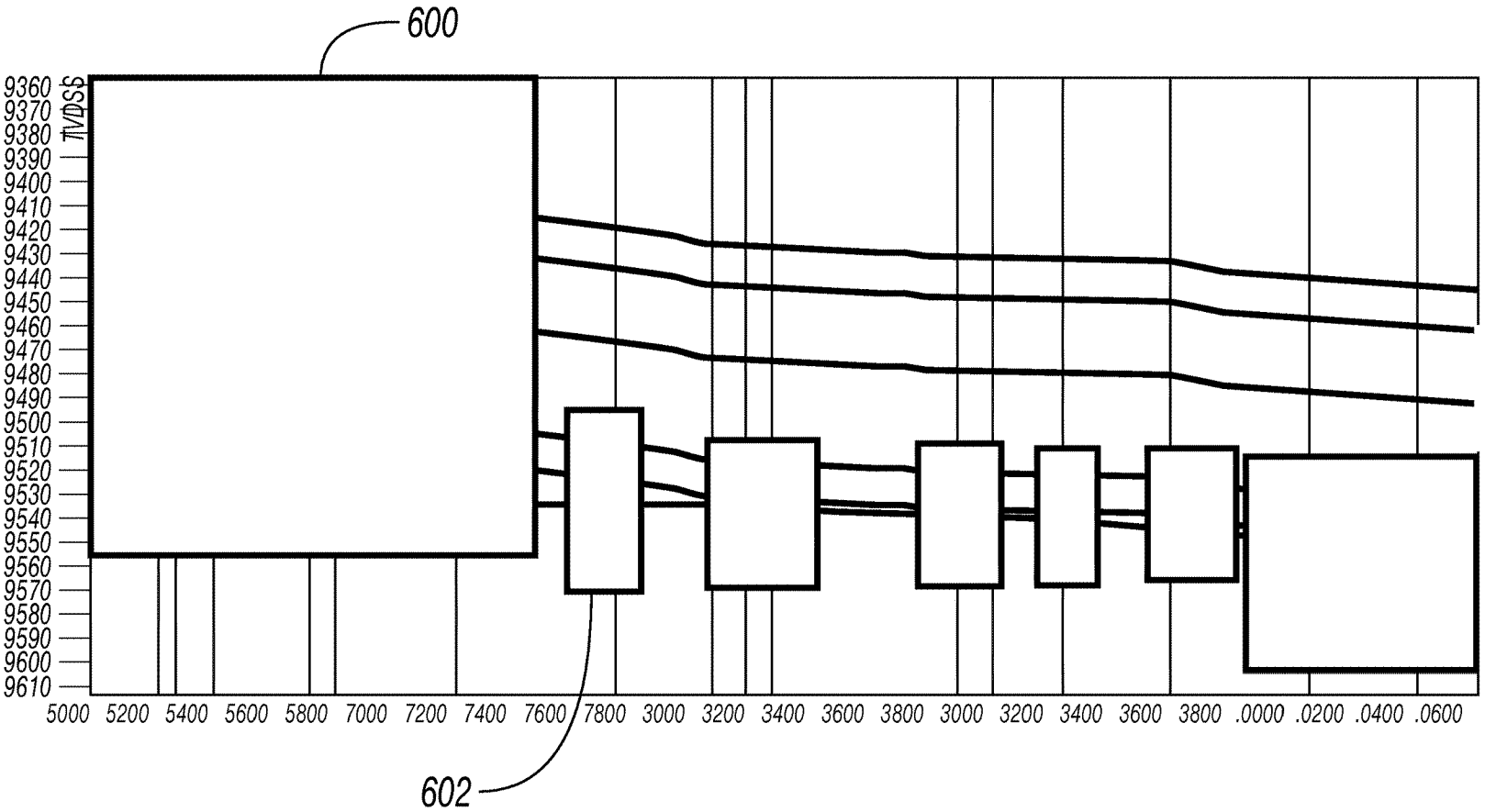
FIG. 6 is a diagram of the example curtain section of FIG. 4 showing 1D processing windows in accordance with embodiment of the disclosure.

For the curtain section shown above in FIG. 4, the 1D processing windows may be defined according to process 500 and as illustrated in FIG. 6. As shown in FIG. 6, Window I (indicated by 600) has a relatively large size as the formation in that region is close to 1D. However, a the Window II (indicated by 602) region contains non-parallel bed boundaries, and thus the expansion of the window to the left and right is stopped sooner than the expansion of Window I, thereby resulting in a smaller window as compared to Window I. As also shown in FIG. 6, the 1D processing windows do not necessarily cover all of the curtain section, as not all the formation may be suitable for 1D processing using the techniques described herein.

Figure 7:
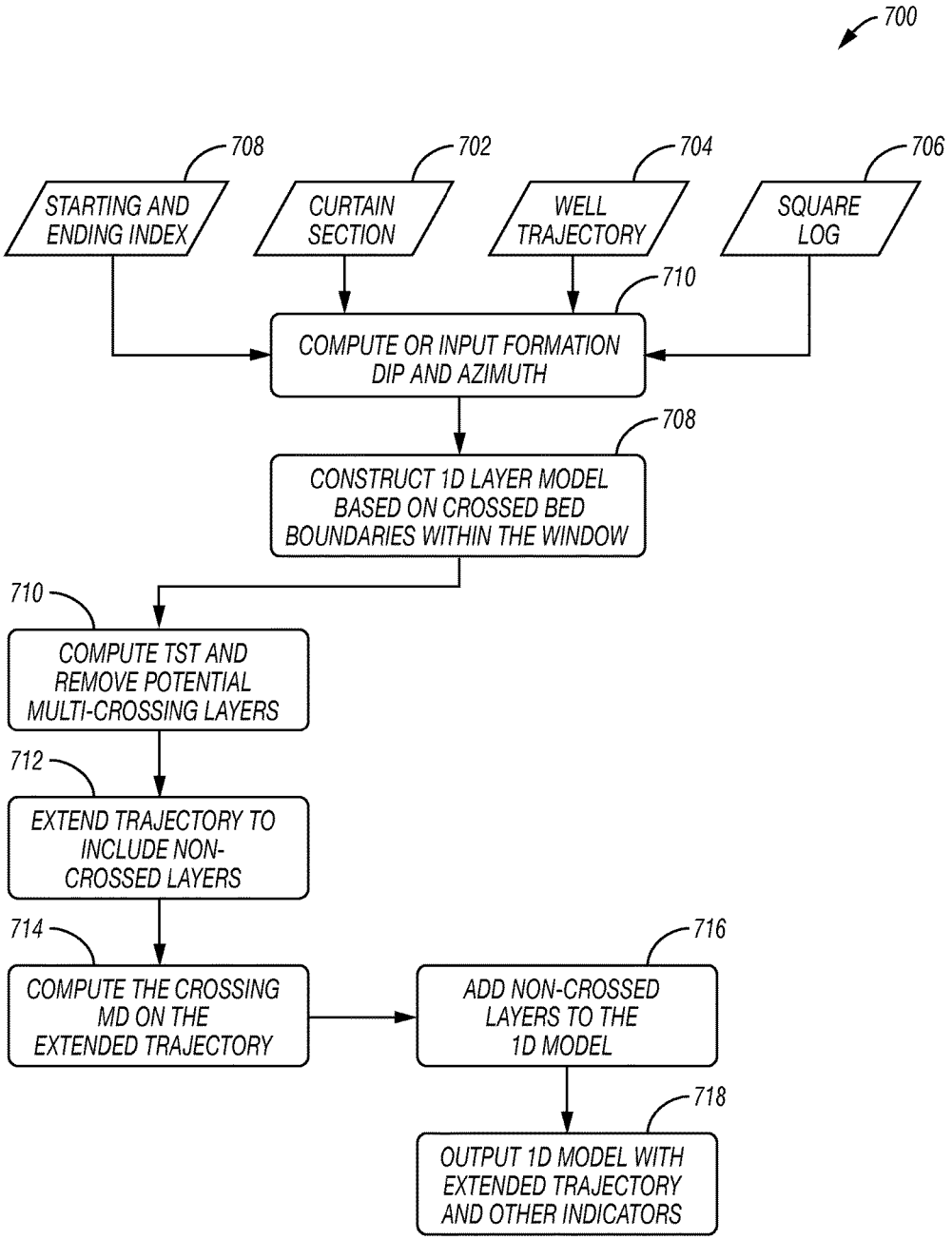
FIG. 7 is a block diagram of an example process for constructing a 1D layered model from 3DP curtain section in accordance with an embodiment of the disclosure.

As mentioned above, because a curtain section or a 3D earth model is built based on a priori knowledge, the curtain section or 3D earth model may be the best candidate as the initial models for further processing, such as 1D inversion. For 1D inversion, a 1D layered model may be used as an initial starting point, which can be built according to curtain section or 3D earth model. FIG. 7 shows an example process 700 for constructing a 1D layered model from 3DP curtain section in accordance with embodiments of the disclosure. As shown in FIG. 7, the process 700 may receive as input, a curtain section 702, a well trajectory 704 and a square log 706, similar to the process 500 for defining 1D processing windows illustrated in FIG. 5. The window size may be defined in terms of the well trajectory 704 within the window, which can be described by starting and ending MD of the trajectory, as discussed above. In some embodiments, the window size may be defined by the starting and ending index of the well trajectory log. In such embodiments, the starting and ending index 708 may be received as input by the process 700.

As described above in process 300, a sub-dataset may be created for each window (block 306) and an initial 1D layered model generated for each window (block 308). For example, taking the first window (Window I) depicted in FIG. 6 as an example, for each crossed bed boundary, the bedding true dip and azimuth may be computed or input from the curtain section, the square log, or a combination thereof (block 710). In some embodiments, the true dip and azimuth of the 1D layered model may be computed by weighted averaging the dips of all crossed boundaries within the window. A 1D layered model may then be constructed for the window based on the crossed bed boundaries within the window and enforcing the newly computed dip and azimuth for all the layers (block 708). Next, bed thickness in true stratigraphic thickness (TST) may then be computed to remove potential multi-crossing layers (block 710), e.g., layers with multi-crossing (negative TST) or very thin layers (near zero TST thickness).

Figure 8:
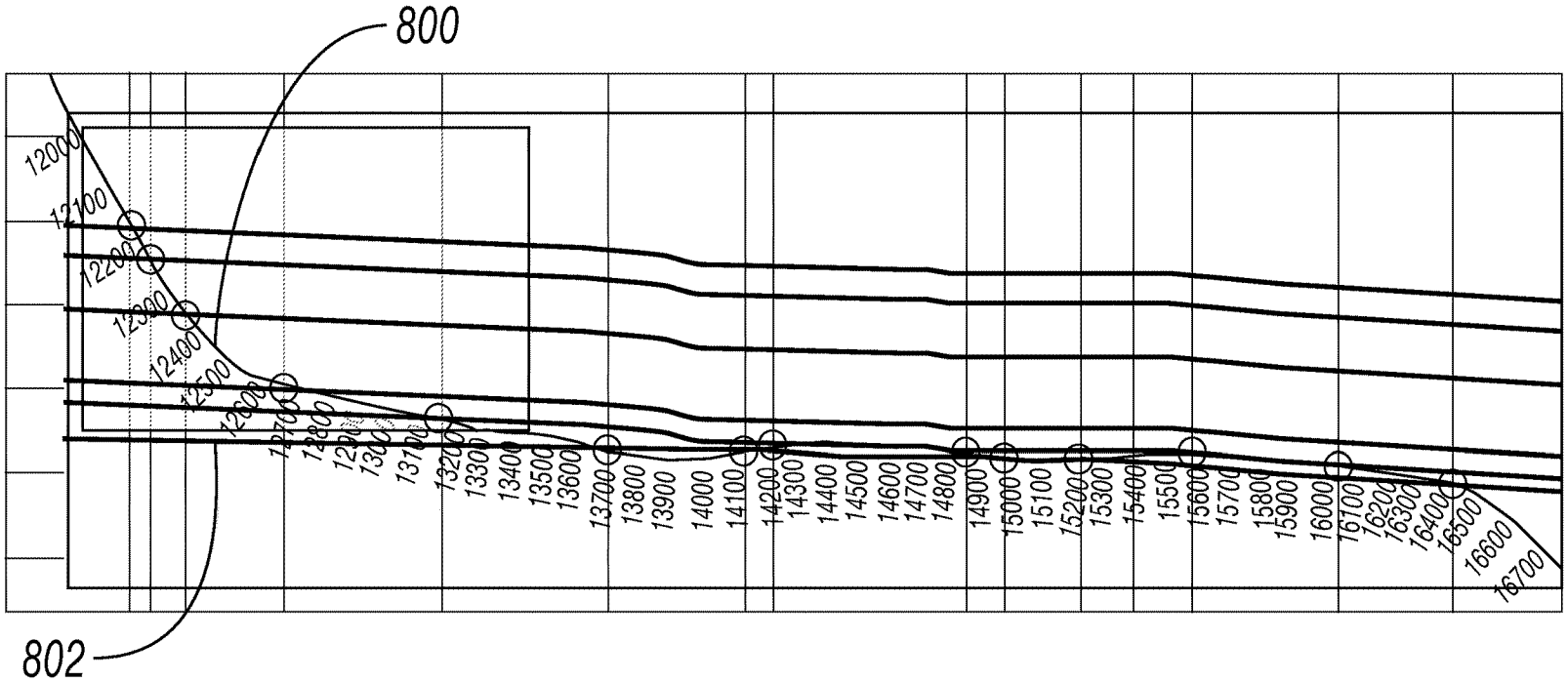
FIG. 8 is a diagram of the example curtain section of FIG. 4 showing a resulting 1D layered model in accordance with an embodiment of the disclosure.

FIG. 8 depicts an example of the resulting 1D layered model 800 below. As can be seen, the resulting 1D layered model 800 for Window I may be a fairly accurate approximation of the curtain section, except, as shown in FIG. 6, the curtain section has an extra bed boundary 800 at the bottom. The bed boundary 800 is missing in the corresponding 1D layered model because it is not crossed by the well trajectory in this example.

Figure 9:
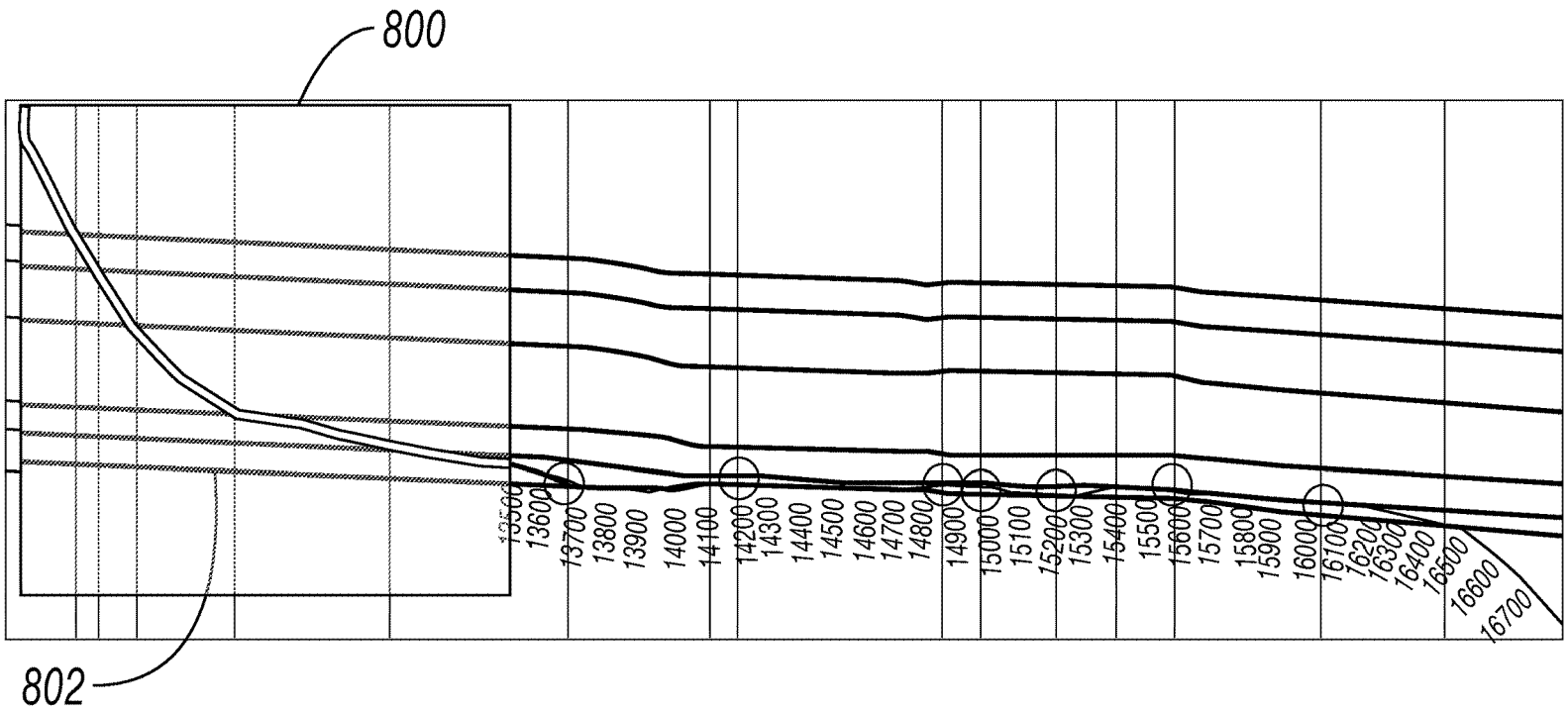
FIG. 9 is a diagram of the example curtain section of FIG. 4 showing a resulting 1D layered mode after taking into account both crossed and non-crossed bed boundaries in accordance with an embodiment of the disclosure.

In some embodiments, the non-crossed layer may be included as it is close enough to the well trajectory and can affect the response of the tool, i.e., it is within the tool DOI. As shown in FIG. 7, in order to include the non-crossed layers, the concept of extended (or imaginary) trajectory may be used. Using such techniques, the trajectory may be extended from both ends of the actual well trajectory (starting and end MD) to include non-crossed layers (block 712). The extension direction may be chosen such that it may only cross the originally non-crossed layers. The crossing MD on the extended trajectory may be computed (block 714). In the example depicted in FIG. 8, the formation is nearly horizontal and the first extended trajectory starts from the starting MD and goes up. The second extended trajectory starts from ending MD and goes down, which crosses the bottom bed boundary 800 in the curtain section. Next, the non-crossed layers may be added to the 1D layered model (block 716). For example, this crossing point at the bottom bed boundary 800 may be used to define the 1D layered model. The 1D layered model may be output with the extended trajectory and other indicators (e.g., multi-crossings, error codes, and the like). FIG. 9 depicts an example of the 1D layered model 800 after taking into account both crossed and non-crossed bed boundaries as described above. As shown in FIG. 9, for example, the 1D layered model is extended to include the bottom bed boundary 800 in the curtain section. The initial Rh and Rv values may be taken from the curtain section and assigned to the layers in the local 1D layered model for Window I.

After a 1D layered model (also referred to as a "local 1D model") has been obtained for Window I, the formation parameters may include, for example, a global dip, Rh, Rv, and bed boundary locations for each layer. An inversion algorithm may be used to invert for all or any subset of these parameters. In some embodiments, an inversion algorithm may also enable setting minimum and maximum values for each parameter to be inverted, assigning prior values, and applying regularization on the inversion.

Figure 10:
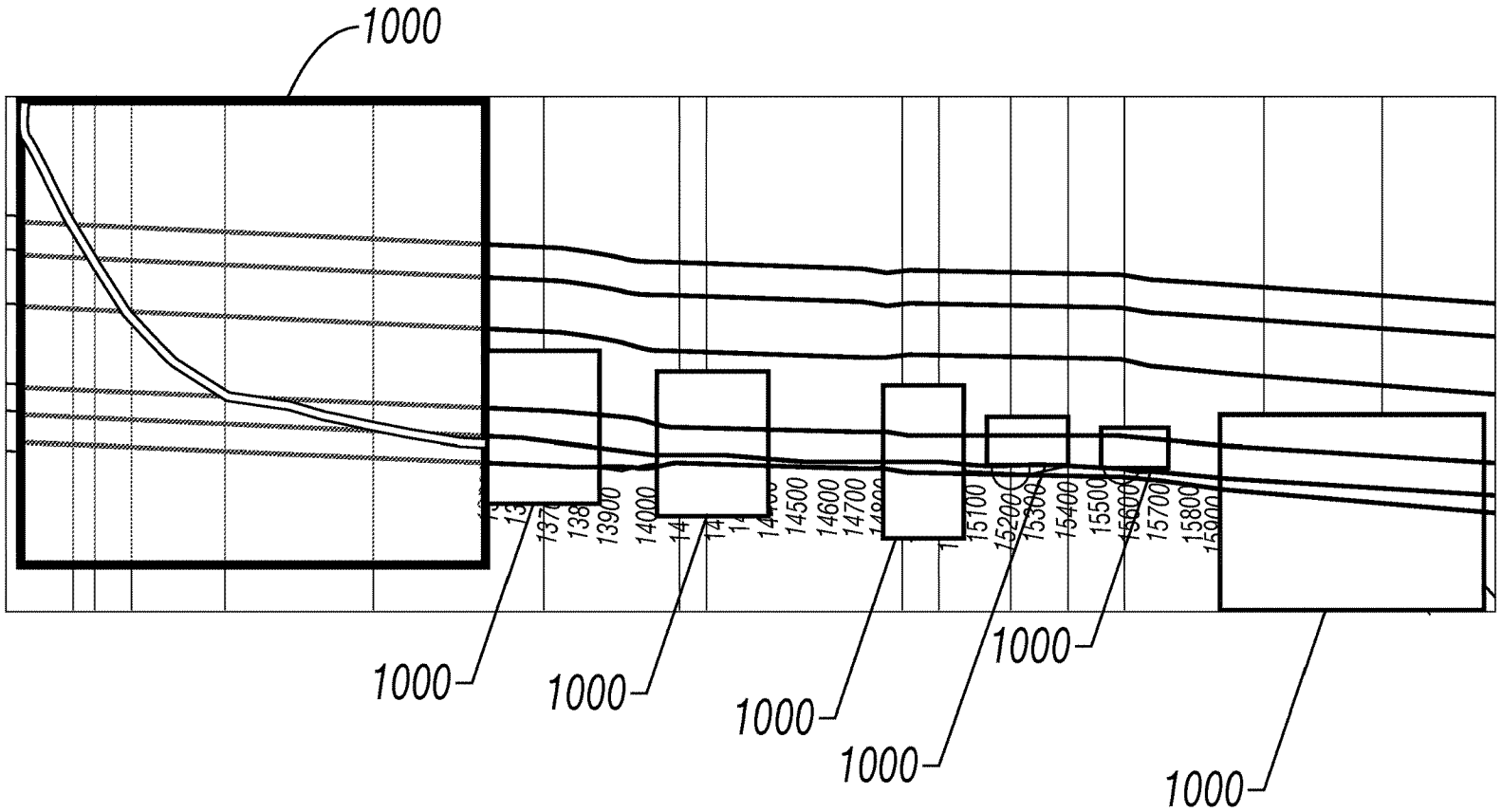
FIG. 10 is a diagram of the example curtain section of FIG. 4 showing inverted 1D models for the selected 1D processing in accordance with an embodiment of the disclosure.

As described above in process 300, a 1D inversion may be performed (block 312) and the inversion may be used in subsequent processing (block 314). Thus, after the initial model, measurement and well trajectory information, and inversion settings are ready, a 1D inversion may be performed to obtain optimal model parameters that best fit the measurement data. FIG. 10 depicts examples of inverted 1D models 1000 for the selected 1D processing windows of the curtain section of FIG. 4 in accordance with an embodiment of the disclosure. In the example depicted in FIG. 10, all the model parameters are inverted. The inversion results may be used to update the curtain section and produce a more accurate 3D earth model.

After performing 1D inversion processing on the 1D processing windows, an original model may be updated to reflect the inversion results. For example, in some embodiments, the original Rh and Rv values may be replaced by the inverted values. In some embodiments, to avoid overwriting the Rh and Rv values from an inversion window with those from other windows, property variation boundaries can be inserted. In some embodiments, the bed boundary locations and dip angle may also be updated in the original model based on the parameters obtained from 1D inversion on the 1D layered models corresponding to the selected processing windows. After the model is updated, a synthetic resistivity log response may be computed using resistivity forward modeling to help ensure that the measured logs match with simulated logs throughout the entire model along the trajectory.

As will be understood, the various techniques described above and relating to applying 1D inversion processing in a non-1D formation are provided as example embodiments. Accordingly, it should be understood that the present disclosure should not be construed as being limited to only the examples provided above. Further, it should be appreciated that the log squaring techniques disclosed herein may be implemented in any suitable manner, including hardware (suitably configured circuitry), software (e.g., via a computer program including executable code stored on one or more tangible computer readable medium), or via using a combination of both hardware and software elements. Further, it is understood that the techniques described herein may be implemented on a downhole processor (e.g., a processor that is part of an electromagnetic logging tool, such as tool 50 of FIG. 2), such that the processing is performed downhole, with the results sent to the surface by any suitable telemetry technique. Additionally, in other embodiments, directional and non-directional electromagnetic measurements may be transmitted uphole via telemetry, and the techniques for applying 1D inversion processing in a non-1D formation may be performed uphole on a surface computer (e.g., one that is part of control system 152 in FIG. 1).

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language is not generally intended to imply that features, elements, and/or operations are in any way used for one or more implementations or that one or more implementations necessarily include logic for deciding, with or without user input or prompting, whether these features, elements, and/or operations are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense and not for purposes of limitation.

What is claimed is:

1. A method, comprising:

obtaining, by one or more processors, a 3D model or curtain section of a subsurface earth formation;

determining, by one or more processors, a processing window with the 3D model or curtain section for 1D inversion processing wherein determining a processing window with the 3D model comprises selecting a base point for the processing window and expanding the processing window from the base point until at least one stopping criterion is met;

building, by one or more processors, a local 1D model for the processing window;

performing, by one or more processors, a 1D inversion on the local 1D model to generate an inverted 1D model having at least one formation parameter; and updating, by one or more processors, the 3D model or curtain section using the at least one formation parameter.

2. The method of claim 1, wherein the 3D model or curtain section is obtained from electromagnetic measurements measured by an electromagnetic logging tool inserted in a well in the subsurface earth formation.

3. The method of claim 1, wherein the at least one stopping criterion comprises at least one of:

bedding angles at one or more crossing points;

a plane dip of one or more bed boundaries within the processing window;

a trajectory azimuth variation within the processing window;

a total window length of the processing window;

zero property variation boundaries within the processing window;

zero faults within the processing window;

whether a well trajectory crosses the same layer bed boundary more than once;

bed thickness variations; or a number of layers within the processing window.

4. The method of claim 1, wherein the at least one formation parameter comprises at least one of: a global dip, horizontal resistivity (Rh), vertical resistivity (Rv), or a bed boundary location.

5. The method of claim 1, wherein building a local 1D model for the processing window comprises: calculating bed thickness in true stratigraphic thickness (TST); and removing layers with a negative TST.

6. The method of claim 1, wherein building a local 1D model for the processing window comprises: extending a well trajectory to include one or more non-crossed layers of the subsurface earth formation; and adding the non-crossed layers to the local 1D model.

7. The method of claim 1 wherein updating the 3D model or curtain section using the at least one formation parameter generates a more accurate 3D model or curtain section of the subsurface earth formation.

8. The method of claim 1 wherein the performing, by one or more processors, a 1D inversion on the local 1D model to generate an inverted 1D model having at least one formation parameter comprises performing the 1D inversion using one or more processors of a downhole tool.

9. The method of claim 8 comprising acquiring sensor data using a sensor of the downhole tool, adjusting at least a portion of the sensor data using the inverted 1D model to generate adjusted sensor data and storing the adjusted sensor data.

10. The method of claim 1 comprising acquiring sensor data using a sensor of a downhole tool and using at least a portion of the sensor data in performing the 1D inversion to generate the inverted 1D model.

11. The method of claim 1 wherein the performing, by one or more processors, a 1D inversion on the local 1D model to generate an inverted 1D model having at least one formation parameter comprises performing the 1D inversion using at least one square log associated with the 3D model or curtain section of the subsurface earth formation.

12. The method of claim 1 wherein the performing, by one or more processors, a 1D inversion on the local 1D model to generate an inverted 1D model having at least one formation parameter comprises performing the 1D inversion using at least one resistivity value at a boundary between two layers of the 3D model or curtain section of the subsurface earth formation.

13. The method of claim 1 comprising acquiring a resistivity log using a logging tool in a well in the subsurface earth formation, generating a resistivity log response using the updated 3D model or curtain section of the subsurface earth formation, and determining an accuracy of the updated 3D model or curtain section via a comparison of the acquired resistivity log and the generated resistivity log.

14. A system, comprising:

one or more processors;

a non-transitory tangible computer-readable memory accessible by the one or more processors and comprising computer-executable instructions, that when executed by one or more processors, causes the one or more processors to perform operations comprising:

obtaining a 3D model or curtain section of a subsurface earth formation;

determining a processing window with the 3D model or curtain section for 1D inversion processing wherein determining a processing window with the 3D model comprises selecting a base point for the processing window and expanding the processing window from the base point until at least one stopping criterion is met;

building a local 1D model for the processing window;

performing a 1D inversion on the local 1D model to generate an inverted 1D model having at least one formation parameter; and updating the 3D model or curtain section using the at least one formation parameter.

15. The system of claim 14, comprising an electromagnetic logging tool, wherein the electromagnetic logging tool is inserted in a well in the subsurface earth formation.

16. The system of claim 15, wherein the 3D model or curtain section is obtained from electromagnetic measurements measured by the electromagnetic logging tool.

17. The system of claim 14, wherein the 3D model or curtain section is obtained from electromagnetic measurements measured by an electromagnetic logging tool inserted in a well in the subsurface earth formation.

18. The system of claim 14, wherein the at least one formation parameter comprises at least one of: a global dip, horizontal resistivity (Rh), vertical resistivity (Rv), or a bed boundary location.

19. A method, comprising:

acquiring sensor data along a trajectory of a borehole in a subsurface earth formation using a tool that comprises a sensor with an associated depth of investigation;

determining a processing window with a stratigraphic multi-dimensional earth model of the subsurface earth formation for 1D inversion processing wherein determining a processing window comprises selecting a base point for the processing window and expanding the processing window from the base point until at least one stopping criterion is met;

determining a localized 1D model that represents features of a portion of the stratigraphic multi-dimensional earth model of the subsurface earth formation; and performing a 1D inversion using the localized 1D model and at least a portion of the sensor data to generate an inverted 1D model that more accurately represents features of the portion of the stratigraphic multi-dimensional earth model of the subsurface earth formation.

20. The method of claim 19, wherein the localized 1D model depends on the depth of investigation of the sensor.

* * * * *